United States Patent [19]

Reid

[11] 4,371,999

[45] Feb. 8, 1983

[54] AIR MATTRESSES

[76] Inventor: Keith Reid, 2082 Zanker Rd., San Jose, Calif. 95131

[21] Appl. No.: 208,079

[22] Filed: Nov. 18, 1980

[51] Int. Cl.[3] ..... A47C 27/08

[52] U.S. Cl. ..... 5/457; 5/449

[58] Field of Search ..... 5/457, 458, 449–456, 5/441

[56] References Cited

U.S. PATENT DOCUMENTS

| | | | |
|---|---|---|---|
| 585,834 | 7/1897 | Ruth | 5/457 |
| 2,542,781 | 2/1951 | Sawyer | 5/475 |
| 2,741,780 | 4/1956 | Kimbrig | 5/457 |
| 3,705,429 | 12/1972 | Nail | 5/455 |
| 3,848,282 | 11/1974 | Viesturs | 5/457 |

FOREIGN PATENT DOCUMENTS

| | | | |
|---|---|---|---|
| 285991 | 2/1928 | United Kingdom | 5/457 |

*Primary Examiner*—Alexander Grosz

*Attorney, Agent, or Firm*—Jack M. Wiseman; Francis W. Anderson

[57] ABSTRACT

An air mattress includes a top and a bottom wall connected by a plurality of longitudinally-extending, laterally-spaced vertical partitions which divide the mattress into a plurality of longitudinal air compartments. The side edges of each partition are secured to the top and bottom walls by means of a heat sealed joint.

4 Claims, 4 Drawing Figures

AIR MATTRESSES

BACKGROUND OF THE INVENTION

The present invention relates in general to air mattresses, and more particularly the present invention relates to an air mattress having a unique arrangement for securing internal vertical partitions to the inner surfaces of the walls of the mattress.

At present, when elongate partitions are to be fastened between the top and bottom walls of an air mattress to form longitudinally-extending, vertical partitions between the walls, upper and lower longitudinal edges of each partition are bent over to define flanges and these flanges are secured to the top and bottom walls by longitudinally-extending heat-sealed seams along substantially the entire length of the partitions, with the ends of the seams terminating short of the end walls of the mattress. With this arrangement, when the air bed is inflated, the top and bottom walls move away from each other, putting the partitions under tension. The tension set up in the partitions tends to cause the ends of the seams to rupture at their juncture with the walls, forming tears in the top or bottom walls through which air will leak out of the mattress.

In the U.S. Pat. No. 3,705,429 to Nail, flexible beams are connected between the top and bottom walls of an air mattress. In one embodiment, the beam is formed of two parallel longitudinal partitions that have seams curved downwardly onto the end wall.

It is an object of the present invention to provide an air mattress in which the longitudinal partitions are sealed to the top and bottom walls in a manner such that the problem of the ends of the seams tearing the walls and causing leaks is substantially obviated.

SUMMARY OF THE PRESENT INVENTION

At each end of a typical air bed, the sheet of material forming the top wall is directed downwardly past the ends of the longitudinal partitions to meet the end of the bottom wall which is directed upwardly at this point. The end portions of the two walls are secured together to form a laterally extending seam. The amount of material in these end portions of the top and bottom walls is such that, when joined together, they form an end wall for the bed that is put under tension by the inflation of the bed. In accordance with the present invention, each longitudinal partition of the bed is made somewhat longer than partitions are usually made and a deep recess is cut in its end portions. Accordingly, at each end, the top and bottom marginal portions of each partition, which provide the flanges that are heat sealed to the walls, extend outwardly past the rest of the partition. When the bed is assembled and the top and bottom walls are joined together to form the end wall, the ends of the seams terminate at points down along the end wall rather than on the top and bottom wall. At these points, the ends of the seams are not subject to a force tending to pull them away from the walls to which they are connected since the end wall absorbs such forces.

DESCRIPTION OF A PREFERRED EMBODIMENT

Figure 1:
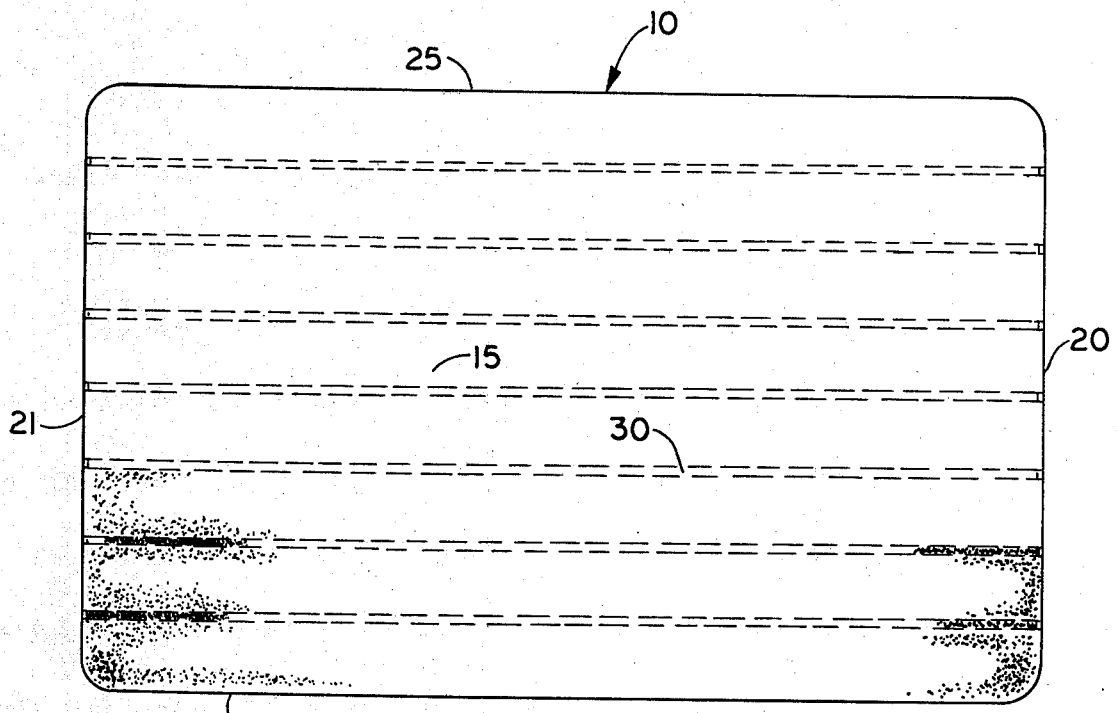
FIG. 1 is a plan view of an air bed incorporating the partition arrangement of the present invention.
Figure 2:
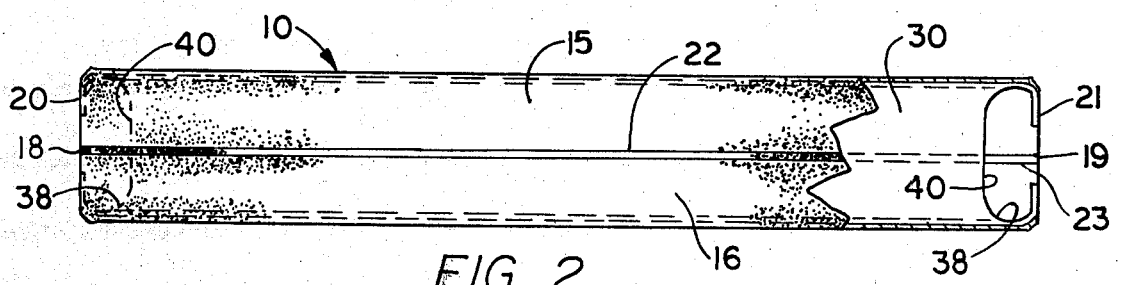
FIG. 2 is a side elevation, with an end portion broken away, of the bed of FIG. 1.

In FIGS. 1 and 2, the reference numeral 10 indicates generally an air bed which comprises a top panel 15 and a bottom panel 16 having downwardly and upwardly directed portions, respectively, connected by sealed end seams 18 and 19 to form end walls 20 and 21, and similarly directed side portions sealed together by side seams 22 and 23 to form side walls 25 and 26. Extending longitudinally of the bed is a plurality of laterally-spaced vertically-disposed partitions 30 each of which has an elongate central body portion **30*a* and right-angle flanges 30*b* and 30*c* on the opposite marginal edges of the central portion. The top and bottom panels of the bed and the partitions are made from sheets of polyvinyl chloride, and the flanges 30*a* and 30*b* are secured to the top and bottom panels 15 and 16 by a tool that applies heat and pressure along an elongated narrow area to form seams 35 and 36**. These seams can also be formed by a conventional vulcanizing process.

Figure 3:
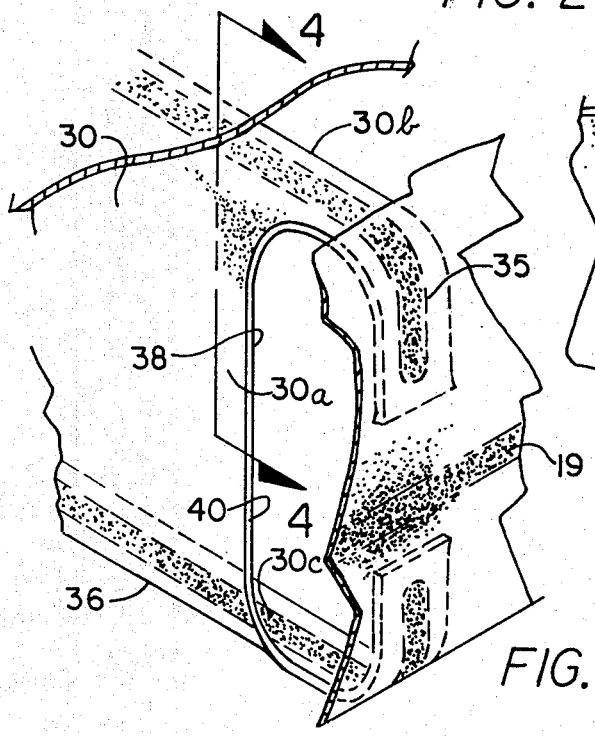
FIG. 3 is an isometric of a portion of the end wall of the bed, the view being taken looking downwardly at an angle.
Figure 4:
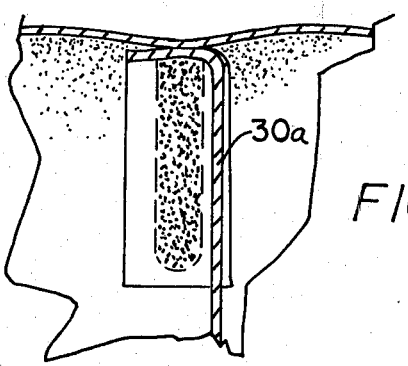
FIG. 4 is a fragmentary end view of a part of one of the partitions, the view being taken looking in the direction of arrows 4—4 of FIG. 3.

It will be noted in FIGS. 2 and 3, that a deep recess 38 is cut in each end of each partition so the flanges **30*a* and 30*b* extend a considerable distance away from the edge 40 of each partition that defines the base of the recess. The length of each partition is chosen so that it is originally longer than the final length of the bed being fabricated but not as long as the top and bottom panels. The recesses 38 are formed so that the inner edge 40 of each recess 38 will be disposed a substantial distance from the adjacent end wall as seen in FIG. 2. With this arrangement the seams 35 and 36 extend downwardly and upwardly, respectively, along the end walls to points adjacent to but not at the seams 18 and 19 in the end walls. As mentioned above, at these points there is no tensile forces tending to pull the ends of the seams away from the wall to which they are attached. The recess 38 permits the flange ends to be brought down along the end walls, completely isolating them from any tensile forces in the body portion 30*a*** of each partition.

I claim:

1. In an air mattress having top and bottom walls that are connected by a plurality of longitudinally-extending partitions which extend from adjacent one end wall of the mattress to a point adjacent the other end wall of the mattress and are secured to the top and bottom walls by seams that connect longitudinal flanges along each edge of each partition to the adjacent top or bottom wall, the improvement which comprises means defining a recess in each end of each partition to provide a pair of spaced flange portions adapted to be bent along the adjacent end wall of the mattress with its end portions secured to the end wall.

2. An inflatable mattress comprising a rectangular top wall having downturned marginal ends and sides, a bottom wall having upturned marginal ends and sides, means securing each marginal end of said top wall to an end of said bottom wall to provide spaced end walls, means securing each marginal side wall of said top wall to one of said side walls of said bottom wall to provide spaced side walls, a plurality of elongate partitions disposed longitudinally between said bottom and top walls, means securing one longitudinal edge of each partition to said top wall and the other longitudinal edge to said bottom wall, means defining a recess in the central portion of each end of each partition to provide two spaced tabs at the edge of each partition end portion, and means securing said tabs to the inner surface of an adjacent end wall.

3. A mattress according to claim 2 wherein said means for securing the longitudinal edges of each partition to the top or bottom wall and the means for securing said tabs to said end walls is a seam formed by applying heat and pressure along a confined area.

4. A mattress according to claim 2 wherein said means for securing the longitudinal edges of each partition to the top or bottom wall and the means for securing said tabs to said end walls are seams formed by vulcanizing a related strip of said top, bottom, and end walls to the selected parts of said partitions.

* * * * *